US008505500B2

(12) United States Patent
Fetterplace

(10) Patent No.: US 8,505,500 B2
(45) Date of Patent: Aug. 13, 2013

(54) ROTARY PISTON ENGINE WITH L-SHAPED PISTON AND CYLINDER

(76) Inventor: Alan Fetterplace, Parramatta (AU)

( * ) Notice: Subject to any disclaimer, the term of this patent is extended or adjusted under 35 U.S.C. 154(b) by 60 days.

(21) Appl. No.: 13/254,186

(22) PCT Filed: Mar. 24, 2010

(86) PCT No.: PCT/AU2010/000335

§ 371 (c)(1),
(2), (4) Date: Sep. 1, 2011

(87) PCT Pub. No.: WO2010/108219

PCT Pub. Date: Sep. 30, 2010

(65) Prior Publication Data

US 2011/0315116 A1 Dec. 29, 2011

(30) Foreign Application Priority Data

Mar. 25, 2009 (AU) ..... 2009901437

(51) Int. Cl.
*F02B 57/00* (2006.01)
*F01B 13/04* (2006.01)

(52) U.S. Cl.
USPC ..... 123/44 D; 123/44 R; 123/45 R

(58) Field of Classification Search
USPC ..... 123/43 R, 44 C, 44 D, 44 R, 45 R
See application file for complete search history.

(56) References Cited

U.S. PATENT DOCUMENTS

| | | | | |
|---|---|---|---|---|
| 890,643 | A * | 6/1908 | Hart | 123/44 C |
| 2,181,705 | A | 11/1939 | Meyer | |
| 2,273,900 | A * | 2/1942 | Sklenar | 123/44 D |
| 3,320,936 | A | 5/1967 | Phalen et al. | |
| 4,836,149 | A * | 6/1989 | Newbold | 123/44 R |
| 5,303,679 | A | 4/1994 | Gamon | |
| 6,457,443 | B1 * | 10/2002 | Lillbacka | 123/44 D |
| 6,895,906 | B1 | 5/2005 | Gahan | |
| 7,677,207 | B2 * | 3/2010 | Nicholson | 123/43 R |

* cited by examiner

*Primary Examiner* — Mary A Davis
(74) *Attorney, Agent, or Firm* — King & Schickli, PLLC

(57) ABSTRACT

An arrangement for a rotary piston type engine (1), the arrangement including an engine housing (2) with a casing plate (3) which divides the housing into first and second adjacent sections (6,7) and a rotatable crankcase (8) passing between the first and second sections (6,7). The first section (6) houses a cylinder block (10) connected to the crankcase (8) so as to be rotatable therewith relative to the engine housing (2), the cylinder block (10) being adapted to house a piston (11). The crankcase (8) is configured to allow passage of a connecting rod (12) which operatively couples the piston (11) to a rotatable crankshaft (13) housed within the crankcase (8). The crankshaft (13) being coupled via a layshaft (20) and a series of gears (21, 22, 23, 24) to the crankcase (8) so as to affect likewise rotation of the crankshaft (13) and the cylinder block (10).

24 Claims, 5 Drawing Sheets

ROTARY PISTON ENGINE WITH L-SHAPED PISTON AND CYLINDER

This application is the national stage of PCT/AU2010/000335, filed Mar. 24, 2010, which claims priority from Australian Application No. 2009901437, filed Mar. 25, 2009, the full disclosures of which are incorporated herein by reference.

TECHNICAL FIELD

The invention generally relates to improvements in rotary two stroke engines.

BACKGROUND ART

It is known to produce two stoke engines of the rotary piston type with a cylinder block, housing a plurality of cylinders, rotatably mounted within the engine housing.

Once such rotary two stoke engine is disclosed in WO 99/18322 (Gahan). This engine includes an engine housing supporting two main bearings within which a crankshaft rotates. A crankcase is configured to rotate over the crankshaft, the crankcase being rigidly attached to the cylinder block which houses opposed cylinders. Each cylinder, in turn, houses a corresponding piston which is slidable within the cylinder. It may be appreciated that, in this configuration, the crankcase, cylinder block, cylinders and plurality of pistons housed therein are able to rotate about the two main bearings relative to the engine housing.

The crankcase is coupled to the crankshaft via a series of gears configured such that rotation of the crankshaft causes likewise rotation of the crankcase and cylinder block, about the two main bearings. The pistons are connected by connecting rods and associated crankpins to the crankshaft such that movement of the pistons causes the connecting rods and associated crankpins to move thereby rotatably actuating the crankshaft. As aforementioned, this rotation of the crankshaft, in turn, actuates the gears which couple the crankshaft and crankcase, so that the cylinder block and pistons therein rotate about the main bearings in response to movement of the pistons.

The series of gears that couple the crankshaft to the crankcase are provided in the form of elliptical gears which provide a gear ration of 2:1 between the crankshaft and the crank case. The elliptical gears include a crankshaft gear located on the crankshaft, a crankcase gear positioned on the crank case and two "piggy back" idler gears configured to be placed between the crankshaft gear aid the crankcase gear. The idler gears are configured place the crankcase gear in positive rotary engagement with the crankshaft permitting 360 degree rotation of the crankshaft to result in 180 degree rotation of the cylinder block.

It may be appreciated that in this configuration, the elliptical gears reside in a relatively confined space defined by the inner walls of the crankcase and the outer walls of the crankshaft. As such, there are limitations on the size of gearing, for example, the idler gears are required to be small. Moreover, although the configuration of the elliptical gears may assist to reduce loading on the crankshaft, the loading now is taken by the elliptical gears, particularly the idler gears, which are now subject to high loading and high rotational speeds.

The opposed cylinders housed within cylinder block are provided in the form of two pairs of opposed cylinders. The pairs of cylinders, housed within the cylinder block, are spaced apart relative to the axis of rotation of the crankshaft with their respective connecting rods and associated crankpins coupled to the crankshaft at laterally spaced positions.

Each piston within the cylinder has an elongated stem between an upper annular flange spaced apart from a lower annular flange, so as to present an I-shape cross section. The connecting rod extending between the lower annular flange and the crankpins couple the connecting rod to the crankshaft.

The cylinders are configured to provide a housing sized such that the piston is able to move from a top dead centre position (TDC), where the upper annular flange adjacent an outer face of the cylinder positioned distal to the crankshaft, to a bottom dead centre (BDC) position where the lower annular flange is positioned adjacent an inner face of the cylinder proximal the crankcase. As such, in the TDC position an induction chamber is defined between the lower annular flange and the inner face of the cylinder while in the BDC position and a power chamber is defined between the upper annular flange and the outer face of the cylinder. Additionally, an ancillary chamber open to the atmosphere is provided between the upper annular flange and the lower annular flange.

Accordingly, it may be appreciated the induction chamber, power chamber and ancillary chambers are coaxial and are radially symmetric about the stem of the respective piston.

During operation, air and fuel is communicated via a port into the power chamber and the piston then moves upwardly toward TDC. As the piston moves the crankshaft is actuated via the connecting rod, which in turn rotates the crankcase and hence the cylinder block. As the cylinder block rotates the port is closed. At the same time, as the piston moves toward TDC, air is drawn into the induction chamber though an inlet tract.

The air-fuel mixture is now ignited by a spark plug and the combustion of the air-fuel mixture then forces the piston downwardly, as the same, again actuating the crankshaft, which in turn rotates the crankcase and hence the cylinder block. As the cylinder block rotates, an exhaust port is opened to allow the hot gases to leave the cylinder. The piston is now returned toward the BDC position. During this motion the inlet tract is closed and a transfer tract is opened such that the lower piston portion squeezes the air out of induction chamber and into the transfer tract, the transfer tract delivering compressed air into the power chamber which is now opening. This air is mixed with fuel, ready for the next power stroke of the engine.

To provide an appropriate volume of air to the power chamber, the induction chamber has a larger diameter than the power chamber. Accordingly, the lower flange of the piston is larger than the upper flange. Furthermore, the upper and lower flanges are concentrically arranged on the stem so as to present an I-shaped cross section, and the connecting rods of the opposing cylinders are laterally spaced apart on the crankshaft.

A disadvantage of this configuration is that the overall size of the cylinder block and therefore the engine is required to be widened to accommodate the larger lower flange of the piston.

To allow air, fuel and exhaust gasses to enter and egress the cylinders, as appropriate, each cylinder has at least one aperture which during rotation becomes aligned with ports within the engine housing. The ports include inlet ports and exhaust ports which are configured to align with the aperture at select intervals during cylinder rotation. For example, the transfer port aligns with the cylinder as is moves toward the BDC position, drawing a fuel air mixture into the cylinder power chamber.

As air, fuel and exhaust gasses must pass from the fixed engine block into apertures which are rotating with the cylinder block, it is important to provide a seal to retain the air, fuel and exhaust gasses whilst allowing the cylinder block to freely rotate. Furthermore, the seals need to be configured such that a sealed passage is defined between the apertures of the cylinders and the inlet ports and exhaust ports.

In particular, the sealing ring needs to provide a sufficient sealing such that hot and pressurised exhaust gases are confined within the exhaust port as the exhaust gases pass between the cylinder block and the engine housing. To achieve this, the seal includes an exhaust port plate with locating hollow dowels which may be received into a receiving blind bore of the engine casing. The hollow dowels and blind bore define a recess into which a spring is able to be housed, the spring biasing the exhaust plate away from the engine housing toward the cylinder block.

A disadvantage of this dowel configuration is that the hot exhaust gases may distort the dowel and/or affect the biasing properties of the spring. This may case the seal between the aperture of the cylinder and the exhaust port in the engine housing to become compromised.

To provide a seal between the connecting rods and the crankshaft housing the crankcase, oil seals are located around and in intimate contact with the connecting rods.

A disadvantage of this configuration is that the oil seals are prone to rapid wear due to the high surface speed of the reciprocating connecting rods.

The engine housing has series of casing plates which define and support various sections of the engine. More particularly, there are three main casing plates, which are spaced apart and coupled together by upper and lower bolts which pass through holes in the casing plates. The space between the casing plates and bolts defines a first cavity in which the cylinder block is housed and a second cavity in which an end of the shaft is housed. In this configuration, a central one the three main casing plates divides the first and second cavities. The central casing plate carries one of the main bearings which receives and supports the crankshaft.

A disadvantage of this configuration is that the forces on the casing plates, in particular, the central casing plate are conferred to the bolts. Another disadvantage is that the configuration of the bolts may not hold the casing plates in strict alignment which is important to maintain alignment of the main bearings and the crank shaft.

SUMMARY OF THE INVENTION

In accordance with one embodiment there is provided an arrangement for a rotary piston type engine, the arrangement including an engine housing with a casing plate which divides the housing into first and second adjacent sections and a rotatable crankcase passing between the first and second sections; and wherein the first section houses a cylinder block connected to the crankcase so as to be rotatable therewith relative to the engine housing, the cylinder block being adapted to house a piston; and wherein the crankcase is configured to allow passage of a connecting rod which operatively couples the piston to a rotatable crankshaft housed within the crankcase; and wherein the crankshaft is coupled via a layshaft and a series of gears to the crankcase so as to affect likewise rotation of the crankshaft and the cylinder block.

In one form, the layshaft is located in the second section.

In one form, the layshaft is parallel to and laterally spaced apart from the crankshaft.

In one form, the series of gears are located in the second section.

In one form, the series of gears includes a crankshaft gear coupled to the crankshaft which engages with a corresponding first timing gear supported by the layshaft.

In one form, the series of gears further includes a second timing gear on the layshaft laterally spaced from the first timing gear.

In one form, the series of gears includes a crankcase gear disposed radially around the outside of the crankcase.

In one form, the crankcase gear is formed integrally with the crankcase.

In one form, the second timing gear is configured to engage with the crankcase gear.

In one form, the cylinder block is formed radially around the crankcase and includes at least one pair of opposed cylinders coupled to the crankshaft housed within the crankcase.

In one form, each of the cylinders includes a smaller upper cylinder portion extending from and laterally offset in relation to a larger lower cylinder portion such that the cylinder bore is substantially L-shaped.

In one form, the pistons are correspondingly L-shaped and are configured to be slidable within the cylinder bore.

In one form, the opposing cylinders are a reverse mirror image of each other.

In another broad form there is provided, an arrangement for a rotary piston type engine, the arrangement including an engine housing with a casing plate which divides the housing into first and second adjacent sections and a rotatable crankcase passing between the first and second sections; and wherein the first section houses a cylinder block which is formed around the crankcase so as to be rotatable therewith relative to the engine housing, the cylinder block being adapted to house at least one pair of opposed cylinders; and wherein the at least one pair of cylinders each house a piston which is operatively coupled via a connecting rod to a crankshaft housed by the crankcase; and wherein the each of the cylinders have a smaller upper cylinder portion extending from and laterally offset relative to a larger lower cylinder portion whereby the cylinder bore is substantially L-shaped.

In one form, the pistons are correspondingly L-shaped and are configured to be slidable within the cylinder bore.

In one form, the opposing cylinders are a reverse mirror image of each other.

In one form, the crankcase is configured to allow passage of connecting rods between the rotatable crankshaft and the pistons.

In one form, the crankshaft is coupled via a layshaft and a series of gears to the crankcase so as to affect likewise rotation of the crankshaft and the cylinder block.

In one form, the layshaft and series of gears are located in the second section.

BRIEF DESCRIPTION OF THE FIGURES

The invention is described, by way of non-limiting example only, by reference to the accompanying drawings, in which.

DETAILED DESCRIPTION OF THE FIGURES AND EMBODIMENTS OF THE INVENTION

The background of invention section identified several disadvantages of known rotary two engines.

One of the disadvantages identified is that the gears, which couple the crankshaft to the crankcase, reside in a relatively confined space defined by the inner walls of the crankcase and the outer walls of the crankshaft. As such, there are limitations on the size of gearing, and configuration of the gearing that may be used, for example, the idler gears are required to be small and therefore are subject to high loading. The invention described herein below seeks to ameliorate these disadvantages by providing a geared coupling between the crankshaft and the crankcase externally to the crankcase. Furthermore, this geared coupling is remote from the cylinder block to provide adequate space for a variety of gearing arrangements.

Another disadvantage identified in the known engine, is that to provide an appropriate volume of air to the power chamber, the induction chamber has a larger diameter than the power chamber. Accordingly; the lower flange of the piston is larger than the upper flange.

Furthermore, the upper and lower flanges are concentrically arranged on the stem so as to present an I-shaped cross section, and the connecting rods of the opposing cylinders are laterally spaced apart on the crankshaft. The invention described herein below seeks to ameliorate these disadvantages by providing "L-shaped" opposing pistons housed within likewise receiving cylinders. The "L-shape" as opposed to an "I-shape" allows the pistons, and couplings between the pistons and crankshaft, to be moved closer together such that the overall dimension of the cylinder block is reduced.

The invention is now described in further detail below with reference to the figures.

Figure 1:
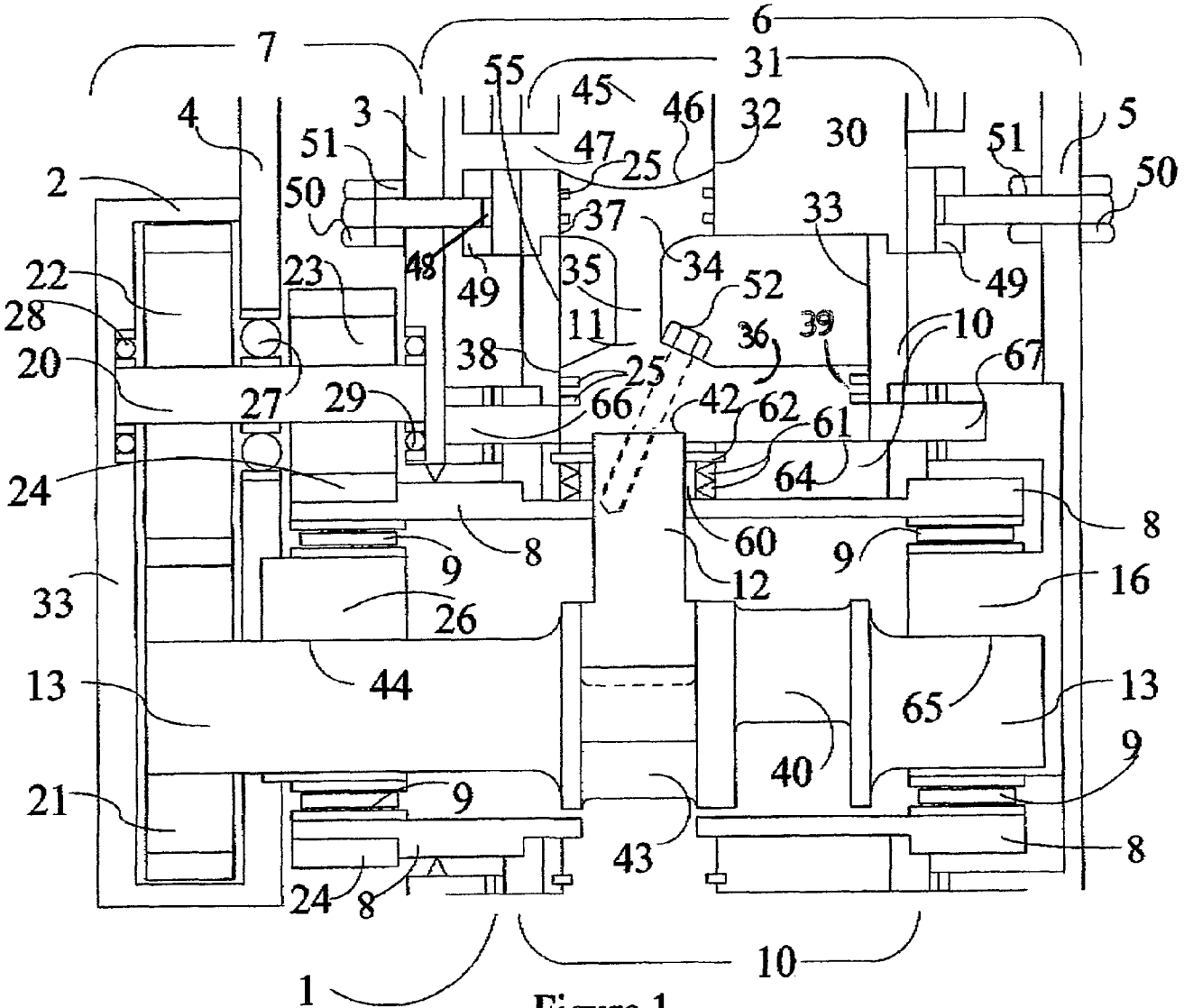
FIG. 1 illustrates partial side view of a two stroke rotary engine.

FIG. 1 shows a side partial view of a rotary piston type engine 1. The engine 1 including an engine housing 2 with a central casing plate 3, between two laterally spaced side casing plates 4 and 5, respectively. The central casing plate 3 dividing the housing 2 into first section 6 adjacent a second section 7 sections and a rotatable crankcase 8 passing between the first section 6 and the second sections 7 through a main bearing 9 which is supported by a main bearing carrier 26 connected to the casing plate 4.

The first section 6 houses a cylinder block 10 connected to the periphery of the crankcase 8 so as to be rotatable therewith relative to the engine housing 2, the cylinder block 10 being adapted to house a series of pistons 11. The crankcase 8 is configured to allow passage of connecting rods 12 which operatively couple the pistons 11 to a rotatable crankshaft 13 housed within the crankcase 8. The crankshaft 13 being supported by main bearing 44 and main bearing 65, internal to the crankcase 8, which are in turn supported by corresponding bearing carriers 26 and 16 which respectively extend inwardly from the casing plates 4 and 5. The crankshaft 13 is coupled via a layshaft 20 and a series of gears (21, 22, 23, 24) to the crankcase 8 so as to affect likewise rotation of the crankshaft 13 and the cylinder block 10.

More specifically, the series of gears includes a crankshaft gear 21 which engages with a first timing gear 22 supported by and coupled to the layshaft 20. The layshaft 20 being supported by a central bearing 27 seated in the side casing plate 4 and two end bearings 28 and 29 respectively seated in the side casing plate 3 and an end plate 33. The layshaft 20 also includes a second timing 23 gear located at an opposing end of the layshaft 20 relative to the first timing gear 22. The second timing gear 23 is configured to engage with a crankcase gear 24, the crankcase gear 24 being formed integral and radially around the outside of the crankcase 8.

Figure 2:
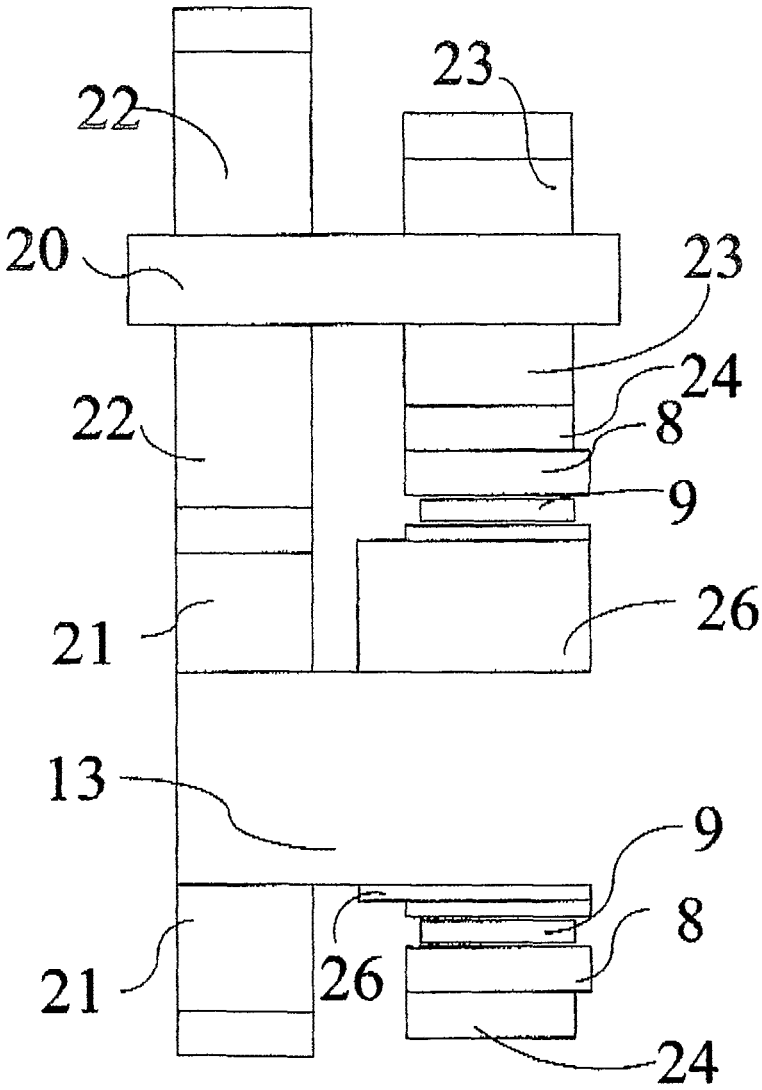
FIG. 2 illustrates partial side view of timing gears between a crank shaft and a lay shaft.

FIG. 2, shows a more detailed view of the series of gears (21, 22, 23, 24), crankshaft 13 and crankcase 8. Additionally, bearing 9 is shown which is supported by corresponding bearing carrier 26.

It may be appreciated that in this configuration the crankshaft 13 is coupled, via the series of gears and layshaft 20, to the crankcase 8 such that rotation of the crankshaft 13 causes likewise rotation of the crankcase 8 and hence the cylinder block 10 connected thereto. The series of gears, in particular, the timing gears 22 and 23 may be configured to provide a select gear ratio between the crankcase 8, layshaft 20 and the crankshaft 13. As an example, the gear ratio between the crankshaft 8 and the first gear 22 on the layshaft 20 may be 1:1 while the ratio between the second timing gear 23 of the layshaft 20 may be of a ratio of 2:1 to the crankcase gear 24. Alternatively, the gear ratio between the crankshaft 13 and the first gear 22 on the layshaft 20 may be 2:1 while the ratio between the second timing gear 23 of the layshaft 20 to the crankshaft gear 24 may be 1:1. Accordingly, the ratio of the series of gears can be configured to produce an overall reduction of 2:1 such that two rotations of the crankshaft 13 equal to one rotation of the crankcase 8.

The cylinder block 10 houses at least one pair of opposed cylinders 30, an example a cylinder 31 is shown in FIG. 1. The cylinder 31 includes an upper cylindrical portion 32 and a lower cylindrical portion 33. The upper cylindrical portion 32 is offset from the lower cylindrical portion 33 so that the cylinder 31 is L-shaped. Accordingly, the piston 11 is correspondingly L-shaped with an upper piston portion 34 coupled via stem 35 to a lower piston portion 36. In this configuration, an outer radial surface 37 of the upper piston portion 34 and an outer radial surface 38 lower piston portion 36 are aligned and seated adjacent a straight wall 55 of the cylinder 31. Furthermore, the lower piston portion 36 extends outwardly from a base 42 of the stem 35 such that an end 39 away from to the stem 35 is located toward the casing plate 5. A connecting rod 12 is coupled to the base 42 of the stem 35 of the piston 11 with an angled set screw 52, the connecting rod 12 then coupling to the crankpin 43 which is in turn coupled to the crankshaft 13. The piston includes piston rings 25 so as to provide a seal between the piston 11 and the cylinder 31.

As FIG. 1 shows only a partial view of the engine, it should be appreciated that there is an additional pair of cylinders (not shown) extending from a second crank pin 40 of the crankshaft 13. The additional cylinders and pistons are similarly configured to the cylinder 31, with the stem of piston being perpendicular to the axis of rotation of the crankshaft.

Furthermore, it should be appreciated that there is also an associated opposing cylinder (not shown) to cylinder 31—these cylinders forming an opposing pair. The opposing cylinder is similarly configured to cylinder 31, however, the L-shape is reversed. That is, the lower portion of the piston extends outwardly from the base of the stem toward the casing plate 3, rather then the casing plate 5.

Accordingly, with this L-shaped configuration, the cylinders 30 can be provided with a larger lower piston portions relative to the upper piston portion, without needing to widen the cylinder block. This may be contrasted to the "I" shaped pistons of the known prior art where lower portions of the pistons are configured radially about the stem, rather then being offset, and therefore require the cylinder to be configured to provide an extended space on both sides of the piston stem, rather than just one, as is achievable with the "L-shape" piston as disclosed herein.

The coupling between the connecting rod 12 and the piston 11 is sealed by a sealing mechanism which includes bushes 60 which may be interspaced between oil seals 61 and the connecting rods 12. These bushes 60 remove the shear friction from the oil seals 61. Furthermore, the bushes 60 should have an internal bore sized to receive the connecting rod 12 by the absolute minimum distance in order to continue the sealing function of the oil seals 61. They may be located by the circlip 62 and the crankcase 8.

The piston 11 in FIG. 1 is shown in the bottom dead centre position (BDC). In this position, an outer chamber 45 is defined between a top (not shown) of the upper cylindrical portion 32 and a top 46 of the upper piston portion 34. During operation, air and fuel is communicated via a port 47 into the outer chamber 45. The piston then moves upwardly toward a top dead centre position (TDC) (not shown). As the piston moves the crankshaft 13 is actuated via the connecting rod 13, which in turn rotates the crankcase 8 and hence the cylinder block 10. As the cylinder block rotates the port 47 is closed.

At the same time, as the piston 11 moves toward TDC an induction chamber 63 is formed between a base 64 of the lower cylindrical portion 36 and bottom of the lower piston portion 36. As the induction chamber 63 is formed air is drawn into though inlets tract 66.

The air-fuel mixture is now ignited by a spark plug (not shown). The combustion of the air-fuel mixture then forces the piston 11 downwardly, at the same time actuating the crankshaft 13, which in turn rotates the crankcase 8 and hence the cylinder block 10.

As the cylinder block 10 rotates an exhaust port 48 is opened to allow the hot gases to leave the cylinder 31 via exhaust plates 49. Additionally, whereby in this motion the inlet tract 66 is closed and transfer tract 67 is opened such that the lower piston portion 36 squeezes the air out of induction chamber 63 and into the transfer tract 67, the transfer tract 67 delivering compressed air into the outer chamber 45 which is now opening. At the completion to this motion the piston is returned toward the BDC position.

Figure 3:
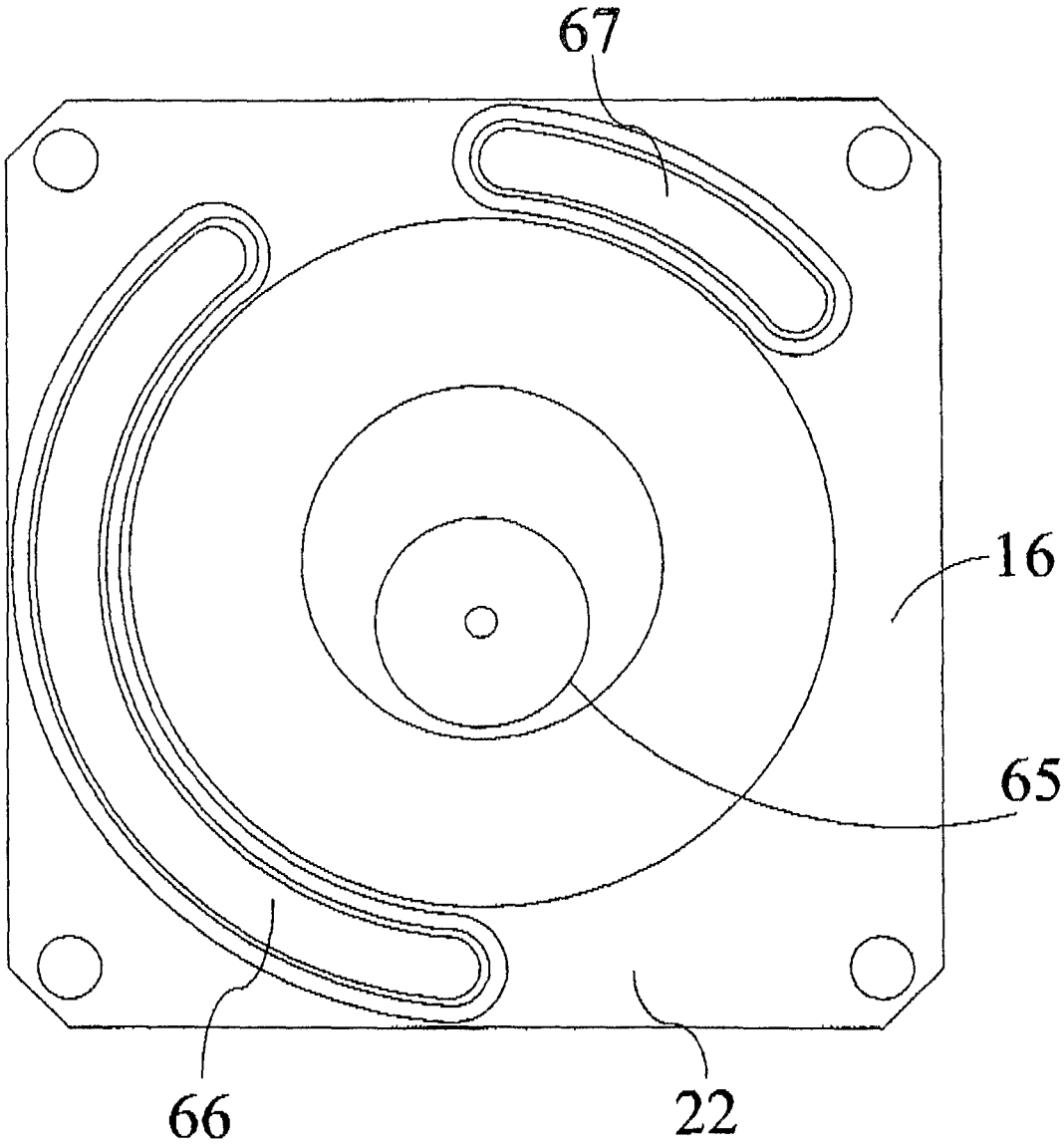
FIG. 3 illustrates a front view of an inlet tract and an outlet tract incorporated in the main bearing carrier.

FIG. 3 shows the inlet tract 66 incorporated into the casing 3 and transfer tract 67 incorporated in the main bearing carrier 16 for accurate alignment. This differs from known prior art engines which have a main bearing carrier separate from the inlet and transfer tracts.

Figure 4:
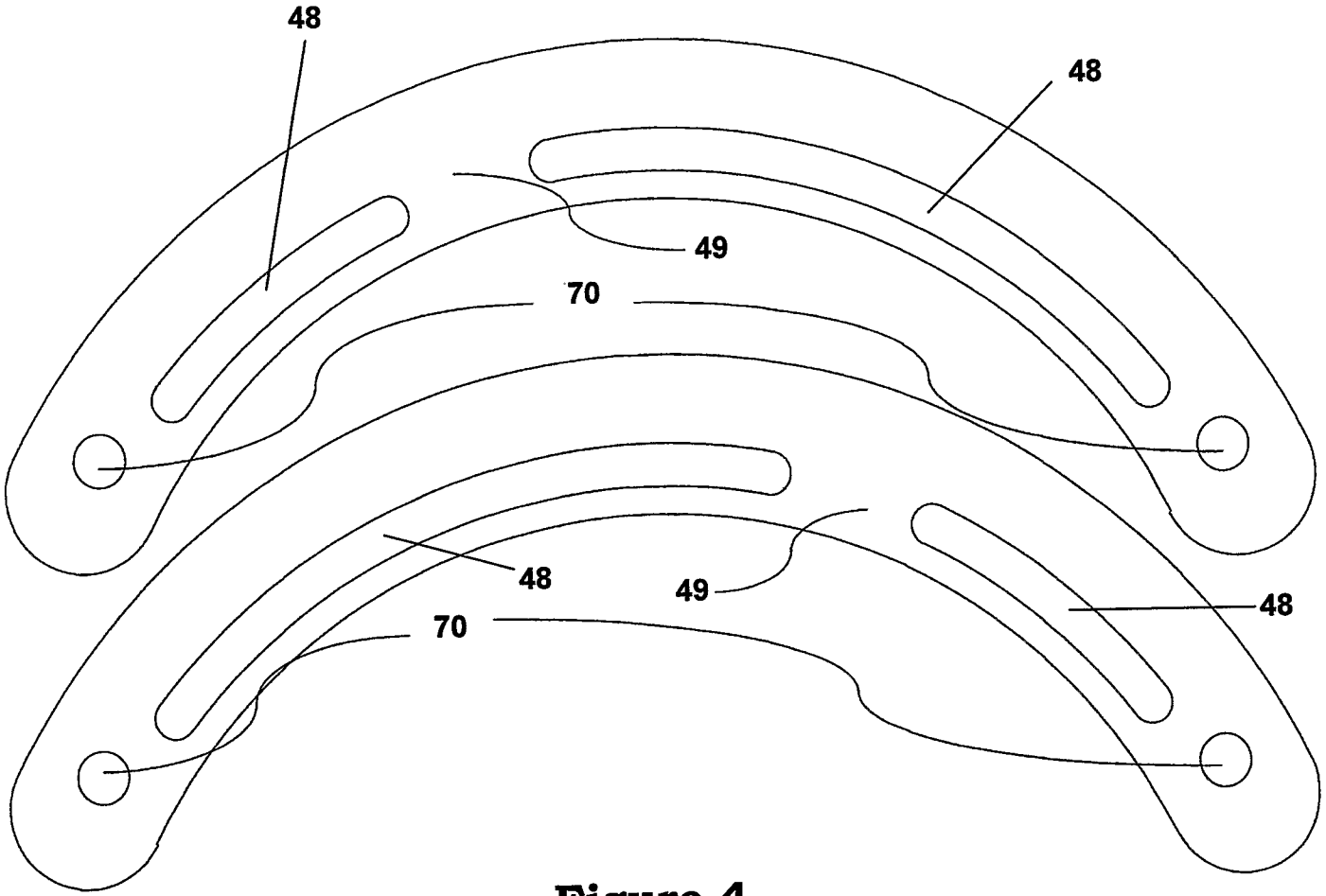
FIG. 4 illustrates a front view of exhaust plates.

Referring to FIGS. 1 and 4, to accommodate the opposing cylinder arrangement, the exhaust plates 49, are located on both sides of the cylinder block 10. The exhaust plates 49 of each side are respectively coupled by set screws 50, each with a lock nut 51 mounted to the central case 3 and the side casing 5, respectively.

More particularly, FIG. 4 illustrates the exhaust plates 49, each having two holes 70 in place of the studs proposed by in the known prior art invention. As shown in FIG. 1, two set screws 50 each with a lock nut 51 mounted in each of the central case 3 and the side casing 5, respectively, to secure the two exhaust plates 49 thereto.

Figure 5:
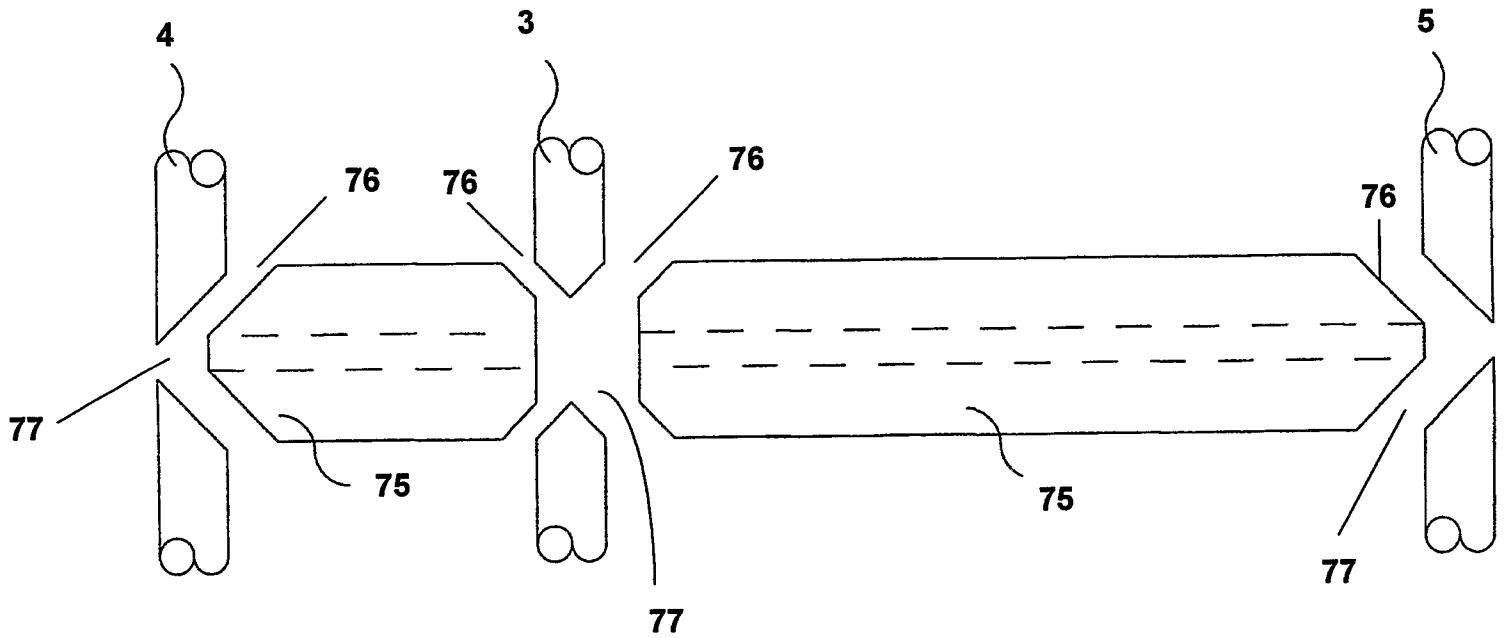
FIG. 5 illustrates view of the end case spacers.

FIG. 5 shows spacers 75 that may be used to laterally space apart and support the central casing plate 3, and the side casing plates 4 and 5. The spacers 75 may be angled at their outer ends with chamfered surfaces 76 with corresponding countersunk acceptance holes 77 machined in central casing plate 3, and the side casing plates 4 and 5 as appropriate. This counter sunk arrangement more rigidly aligns and supports central casing plate 3, and the side casing plates 4 and 5 in comparison to the bolt through arrangements proposed in the known prior art.

Many modifications will be apparent to those skilled in the art without departing from the scope of the present invention.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

LIST OF PARTS

1. Engine
2. Engine housing
3. Central casing plate
4. Side casing plate
5. Side casing plate
6. First Section
7. Second section
8. Crankcase
9. Main bearing
10. Cylinder block
11. Pistons
12. Connecting rods
13. Crankshaft
16. Main bearing carrier
20. Layshaft
21. Crankshaft gear
22. First timing gear
23. Second timing gear
24. Crankcase gear
25. Piston rings
26. Main bearing carrier
27. Central bearing
28. End bearing
29. End bearing
30. Opposed cylinders
31. Cylinder
32. Upper cylindrical portion
33. Lower cylindrical portion
34. Upper piston portion
35. Stem
36. Lower piston portion
37. Outer radial surface of upper piston
38. Outer radial surface of lower piston
39. End
40. Second crankpin
42. Base
43. Crankpin
44. Crankshaft main bearing
45. Outer chamber
46. Top
47. Port
48. Exhaust port
49. Exhaust plate
50. Screws
51. Locknuts
52. Angled set screw
55. Straight wall
60. Bushes
61. Oil seals
62. Circlip
64. Base
65. Crankshaft main bearing

66. Inlet tract
67. Transfer tract
70. Holes
75. Spacers
76. Chamfered surfaces
77. Counter sunk hole

The invention claimed is:

1. An arrangement for a rotary piston engine, the arrangement including an engine housing with a casing plate which divides the housing into first and second adjacent sections and a rotatable crankcase passing between the first and second sections; and wherein the first section houses a cylinder block connected to the rotatable crankcase so as to be rotatable therewith relative to the engine housing, the cylinder block being adapted to house a piston; and wherein the rotatable crankcase is configured to allow passage of a connecting rod which operatively couples the piston to a rotatable crankshaft housed within the rotatable crankcase; and wherein the rotatable crankshaft is coupled via a layshaft and a series of gears to the rotatable crankcase so as to affect likewise rotation of the rotatable crankshaft and the cylinder block.

2. The arrangement of claim 1 wherein the layshaft is located in the second section.

3. The arrangement of claim 1, wherein the layshaft is parallel to and laterally spaced apart from the rotatable crankshaft.

4. The arrangement of claim 1, wherein the series of gears are located in the second section.

5. The arrangement of claim 4, wherein the series of gears includes a crankshaft gear coupled to the rotatable crankshaft which engages with a corresponding first timing gear supported by the layshaft.

6. The arrangement of claim 5, wherein the series of gears further includes a second timing gear on the layshaft laterally spaced from the first timing gear.

7. The arrangement of claim 6, wherein the series of gears includes a crankcase gear disposed radially around the outside of the rotatable crankcase.

8. The arrangement of claim 7, wherein the crankcase gear is formed integrally with the rotatable crankcase.

9. The arrangement of claim 7, wherein the second timing gear is configured to engage with the crankcase gear.

10. The arrangement of claim 1, wherein the cylinder block is formed radially around the rotatable crankcase and includes at least one pair of opposed cylinders coupled to the rotatable crankshaft housed within the rotatable crankcase.

11. The arrangement of claim 10, wherein each of the at least one pair of opposed cylinders includes a smaller upper cylinder portion extending from and laterally offset in relation to a larger lower cylinder portion, and wherein the at least one pair of opposed cylinders each include a cylinder bore that is substantially L-shaped.

12. The arrangement of claim 11, further including at least one pair of pistons corresponding to the at least one pair of opposed cylinders, wherein the at least one pair of pistons are correspondingly L-shaped and are configured to be slidable within the cylinder bore.

13. The arrangement of claim 12, wherein the at least one pair of opposing cylinders are a reverse mirror image of each other.

14. An arrangement for a rotary piston engine, the arrangement including an engine housing with a casing plate which divides the housing into first and second adjacent sections and a rotatable crankcase passing between the first and second sections; and wherein the first section houses a cylinder block which is formed around the rotatable crankcase so as to be rotatable therewith relative to the engine housing, the cylinder block being adapted to house at least one pair of opposed cylinders; and wherein the at least one pair of opposed cylinders each house a piston which is operatively coupled via a connecting rod to a crankshaft housed by the rotatable crankcase; and; wherein the each of the at least one pair of opposed cylinders have a smaller upper cylinder portion extending from and laterally offset relative to a larger lower cylinder portion whereby the cylinder bore is substantially L-shaped.

15. The arrangement of claim 14, wherein the pistons are correspondingly L-shaped and are configured to be slidable within the cylinder bore.

16. The arrangement of claim 15, wherein the at least one pair of opposing cylinders are a reverse mirror image of each other.

17. The arrangement of claim 14, wherein the rotatable crankcase is configured to allow passage of connecting rods between the crankshaft and the pistons.

18. The arrangement of claim 14, wherein the crankshaft is coupled via a layshaft and a series of gears to the rotatable crankcase so as to affect likewise rotation of the crankshaft and the cylinder block.

19. The arrangement of claim 18, wherein the layshaft and the series of gears are located in the second section.

20. An apparatus for a rotary piston type engine, comprising:

an engine housing with a casing plate dividing the housing into first and second adjacent sections;

a rotatable crankcase passing between the first and second sections, a cylinder block in the first section and connected to the rotatable crankcase so as to be rotatable therewith relative to the engine housing, the cylinder block housing a piston; and a connecting rod operatively coupling the piston to a rotatable crankshaft housed with in the rotatable crankcase, the rotatable crankshaft coupled via a layshaft and a series of gears to the rotatable crankcase so as to effect rotation of the rotatable crankshaft and the cylinder block.

21. The apparatus of claim 20, further including a sealing mechanism for sealing the coupling between the connecting rod and the piston.

22. The apparatus of claim 21, wherein the sealing mechanism comprises at least one bush including an internal bore for receiving the connecting rod.

23. The apparatus of claim 22, wherein the sealing mechanism further comprises at least one oil seal, wherein the bush is positioned between the connecting rod and the oil seal.

24. The apparatus of claim 23, further including a fastener for retaining the sealing mechanism relative to the rotatable crankcase.

* * * * *